US008915330B2

(12) United States Patent
Henshaw et al.

(10) Patent No.: US 8,915,330 B2
(45) Date of Patent: Dec. 23, 2014

(54) LUBRICATION OF POSITIVE DISPLACEMENT EXPANDERS

(75) Inventors: Iain Henshaw, Tewkesbury (GB); James Derby, Liverpool (GB); Ian Glease, Cumbria (GB)

(73) Assignee: Energetix PNU Power Limited, Capenhurst, Chester (GB)

( * ) Notice: Subject to any disclaimer, the term of this patent is extended or adjusted under 35 U.S.C. 154(b) by 1090 days.

(21) Appl. No.: 12/867,007

(22) PCT Filed: Jan. 21, 2009

(86) PCT No.: PCT/GB2009/050043

§ 371 (c)(1), (2), (4) Date: Oct. 29, 2010

(87) PCT Pub. No.: WO2009/101427

PCT Pub. Date: Aug. 20, 2009

(65) Prior Publication Data

US 2011/0031068 A1 Feb. 10, 2011

(30) Foreign Application Priority Data

Feb. 11, 2008 (GB) ..... 0802475.4

(51) Int. Cl.
*F01M 5/00* (2006.01)
*C10M 171/00* (2006.01)

(52) U.S. Cl.
CPC ..... *C10M 171/00* (2013.01); *C10N 2220/022* (2013.01); *C10N 2240/30* (2013.01)
USPC ..... 184/6.22

(58) Field of Classification Search
CPC ..... F16C 33/6662; F16N 7/32; B65G 45/02; B65H 75/10; C09K 2205/12
USPC ..... 184/6.22; 62/87
See application file for complete search history.

(56) References Cited

U.S. PATENT DOCUMENTS

| | | | | |
|---|---|---|---|---|
| 2,149,127 | A * | 2/1939 | Tear | 222/56 |
| 3,666,049 | A * | 5/1972 | Kern et al. | 26/104 |
| 4,677,949 | A * | 7/1987 | Youtie | 123/235 |
| 5,067,590 | A * | 11/1991 | King et al. | 184/15.1 |
| 5,195,327 | A * | 3/1993 | Kim | 62/84 |
| 6,413,062 | B1 | 7/2002 | Peters | |
| 6,640,933 | B2 * | 11/2003 | Henry et al. | 184/5.1 |
| 7,234,310 | B2 * | 6/2007 | Flynn et al. | 62/114 |
| 2001/0003247 | A1 * | 6/2001 | Lundberg | 60/648 |
| 2004/0172945 | A1 * | 9/2004 | Kimura et al. | 60/643 |
| 2006/0130495 | A1 | 6/2006 | Dieckmann et al. | |
| 2008/0202116 | A1 * | 8/2008 | Benstead et al. | 60/538 |

FOREIGN PATENT DOCUMENTS

| | | |
|---|---|---|
| EP | 1 211 302 | 6/2002 |
| EP | 1 387 131 | 2/2004 |
| WO | WO2007109859 | 10/2007 |

OTHER PUBLICATIONS

International Search Report mailed Jul. 15, 2009 in co-pending related International Application No. PCT/GB2009/050043, 2 pages.
Search Report dated May 30, 2008 issued in co-pending related Application No. GB0802475.4, 1 page.

* cited by examiner

*Primary Examiner* — Michael Mansen
*Assistant Examiner* — Michael Riegelman
(74) *Attorney, Agent, or Firm* — Meunier Carlin & Curfman, LLC

(57) ABSTRACT

A method and system for lubricating a positive displacement machine operating as an expander of a compressed gas, comprising introducing into an expansion chamber of the machine a lubricant whose pour point temperature is greater than the operating temperature of the machine in the expansion chamber as determined by the expanding gas, which thus causes the lubricant to freeze-adhere to the internal surfaces of the expansion chamber, to become fluid under increased pressure at a point of contact of the working surfaces of the expander and then to refreeze when the surfaces separate. Considerable reduction in the quantity of lubricant is realized with the attendant advantage that dis-entrainment of lubricant from the gas exhausted from the machine is largely avoided.

20 Claims, 3 Drawing Sheets

LUBRICATION OF POSITIVE DISPLACEMENT EXPANDERS

FIELD

This invention concerns a method of internally lubricating a positive displacement machine when operating as an expander of a compressed gas.

Such a machine which may be in the form of a scroll expander, a screw type expander or one using movable vanes, requires a degree of lubrication of the working surfaces of the expander thus to avoid wear of such surfaces which in time would prevent the expander from operating in a positive manner.

BACKGROUND

Typically in such a machine where the gas flow into the expander may be in excess of 200 liters per minute, a lubricant must be supplied and injected into the expansion chamber of the machine, at a rate of around 10 milliliters per minute. In addition to the cost of using mineral oil lubricants at such a flow rate and accommodating a reservoir of sufficient size, there are additionally difficulties in subsequently separating the lubricant from the gas exhausted from the expander, since the lubricant will typically be entrained as a mist or fume.

SUMMARY

It is an object of the present invention to provide a method of lubricating a positive displacement expander, and to provide a system incorporating the expander, a supply of compressed gas and a reservoir of lubricant, wherein the aforementioned concerns are substantially alleviated.

According to the present invention there is provided a method of lubricating a positive displacement machine operating as an expander of a compressed gas, comprising the steps of introducing into an expansion chamber of the machine a lubricant whose pour point temperature is greater than the reduced operating temperature of the machine in said expansion chamber as determined by the expanding gas, thus causing the lubricant to freeze-adhere to the internal surfaces of the expansion chamber.

The lubricant may be introduced into the expansion chamber simultaneously with the compressed gas to be expanded.

The lubricant may be contained with the compressed gas in a storage vessel prior to its supply to the positive displacement machine, or alternatively the lubricant may be introduced into the expansion chamber from a reservoir separate from a storage vessel containing the compressed gas.

The pour point temperature of the lubricant may exceed the operating temperature of the machine in the expansion chamber by at least 50° C.

The temperature differential determined by the pour point of the lubricant and the operating temperature of the machine in the expansion chamber may be such that the freeze-adhered lubricant becomes fluid under increased pressure at a point of contact of the working surfaces of the expander, then refreezes when the surfaces separate.

The volume of lubricant introduced into the machine, per unit time, may be in the region of 0.0005% of the volume of compressed gas passing through the machine for the same unit time.

The temperature of the lubricant prior to introduction into the expansion chamber may be controlled such that it remains fluid until frozen in the expansion chamber by the expanding gas.

Further according to the present invention there is provided a system comprising a positive displacement expander; a supply of compressed gas connected to the expander; and means connected to the expander to supply thereto a lubricant having an inherent pour point temperature greater than the operating temperature of the gas when expanding within the expansion chamber of the expander.

The system may include means to control the temperature of the lubricant supplied to the expansion chamber.

DETAILED DESCRIPTION

Figure 1:
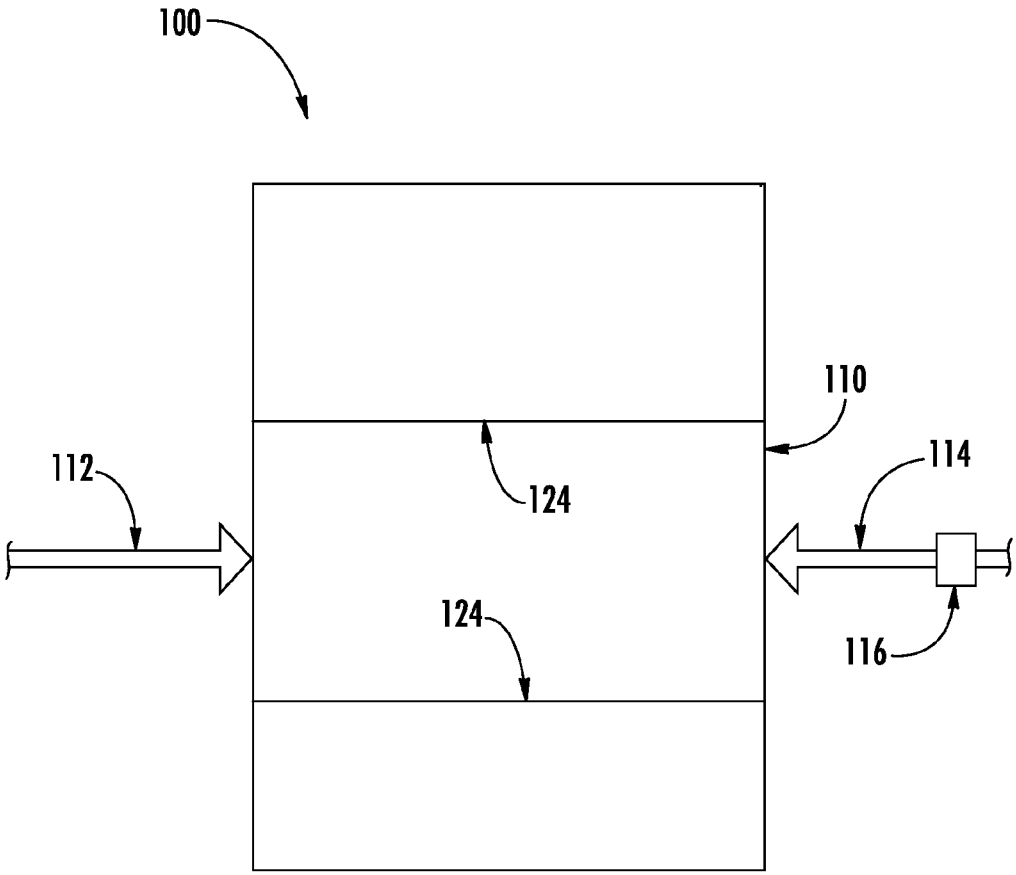
FIG. 1 depicts schematically one embodiment of a system comprising a positive displacement expander disclosed herein.

The invention is principally, though not exclusively, intended for use with a system for producing an uninterrupted supply of electrical power by providing a supply of compressed gas, usually air, and passing the gas through a positive displacement expander such as a scroll compressor operating in reverse to expand the gas, the rotor of the expander being connected to an electrical generator to produce electrical power in the event of failure of the mains electrical supply.

A scroll expander operating this way requires lubrication to prevent wear of the contacting surfaces of the machine, while providing a seal between the expanding pockets of gas.

Low pour point mineral oils will, in conventional methods, require a supply of a lubricant somewhere in the region of 10 milliliters per minute for a gas flow into the system in excess of 200 liters per minute for an output power typically in the region of 20 KW, and an inlet pressure of 40-50 bar, for example. The oil then becomes entrained within the expanding gas which, in an open loop system, cannot be permitted, on exhaust, to escape into the atmosphere without dis-entraining the oil mist or fume from the gas. Additionally, utilisation of lubricant at this kind of level, in order to be economically acceptable, requires that the oil be recovered for re-use.

The present invention is based upon the concept that a lubricant oil which will freeze-adhere to the internal surfaces of the machine during its operation will require a much lower quantity of lubricant which in turn reduces the amount of lubricant required to be collected on exhaust from the machine. This, in turn, enables the design of such a system to be improved insofar as a storage reservoir for the oil may be considerably smaller. For this purpose, a mineral oil, for example BP RCR 32, having a pour point of approximately −20° C. may be selected as the lubricant for use in a scroll expander whose operating temperature is typically in the region of −85° C. so that the pour point of the lubricant is at least 50° C. and in this example some 65° C. greater than the operating temperature of the machine.

As the oil enters the expansion chamber it immediately becomes frozen and adheres to the internal working surfaces of the scroll and the body of the machine until, momentarily, it experiences the intense pressure created by the working surfaces coming into contact whereupon the lubricant melts and becomes fluid at that point thus to provide the protecting and sealing properties of the lubricant. Then, as the working surfaces separate, the lubricant refreezes on the cold expander surfaces thus preventing the lubricant from being displaced with the expanding gas.

Experimentation revealed that if the compressed gas entering the machine is preheated, such that its temperature did not fall below the pour point of the lubricant, a minimum supply rate for the lubricant was 10 milliliters per minute when introduced with the heated gas. When the experiment was repeated with unheated gas a rate of lubricant supply as little as 1 milliliter per minute was found sufficient since the working temperature was then below the pour point of the lubricant. In the repeat experiment the scroll expander was operated for approximately 30 minutes with a lubricant feed rate of 1 milliliter per minute, whereupon the machine was opened up for inspection and the oil was found to have been evenly distributed across the scroll labyrinth faces as a frozen film.

In a further experiment a lubricant having a pour point lower than the normal working temperature of the expander was used and the lubricant remained in a fluid state within the machine. Under those conditions a lubricant feed rate of 10 milliliters per minute was required in order to protect the scroll labyrinth faces from wear and so it was clear that the freeze-adhering of lubricant on to the scroll faces has significant advantage since it increases lubricant retention in the system and considerably reduces the quantity of lubricant required.

Operating parameters using a high pour point lubricant were found to be that 1 milliliter of the mineral oil lubricant per minute was adequate with a gas flow into the system of 210 liters per minute of gas at 40 bar pressure. By volume, this equates to 0.0005% of lubricant to gas. The volume of lubricant required may be determined according to the output power, or the rotational speed, or a combination of both parameters.

By significantly reducing the amount of lubricant required in a machine of this kind there is a considerable cost saving in the manufacture of such a system since the lubricant reservoir can be kept as compact as possible, and it is conceivable also that the product could be sealed for life with a 2-liter oil reservoir being sufficient to provide the system with lubricant for its expected lifetime which therefore would never require replenishment.

The concept is of considerable value on the exhaust side of the system since the oil is frozen on exit from the scroll and makes it much easier to dis-entrain from the exhausted gas than if the oil were in a mist or a fume. The reduced amount of lubrication also means that the amount of oil needed to be collected on exit from the scroll is considerably reduced which is of particular value in an open loop system where re-circulating the lubricant would be difficult or costly to achieve and so keeping the lubricant required to a minimum alleviates the need for excessive filtering of the exhaust gas and allows for longer periods between system maintenance.

Where a positive displacement expander is to be used in environments where the ambient temperature falls below the pour point of the lubricant it may be necessary slightly to heat the lubricant prior to introduction into the chamber in order to keep it liquid such that it easily flows through the system prior to introduction. Additionally, there may be some advantage in monitoring and controlling the temperature of the lubricant so that when it becomes entrained in the gas stream it is at an ideal temperature so that it freeze-adheres instantly on contact with the working surfaces.

As an alternative to reservoir storage, the lubricant may be contained within the compressed gas in a storage vessel prior to supply to the positive displacement machine such that the moist gas serves as the lubricant within the machine and/or mixes with another lubricant such as a mineral oil to create an emulsion which freeze-adheres to the working surfaces within the machine. In some cases, if air is the stored compressed gas, moisture (water) naturally present in the compressed air may alone serve as the lubricant or may combine with another lubricant to form an emulsion. Alternatively, the lubricant may be another aqueous-based liquid alone or mixed with an oil-based liquid, all provided that it's freezing (pour point) temperature is above the operating temperature of the machine in the expansion chamber.

One embodiment of a system disclosed herein is depicted schematically in FIG. 1. FIG. 1 shows a system comprising a positive displacement expander 100 having an expansion chamber 110; a supply of compressed gas 112 connected to the expander 100; and means 114 connected to the expander 100 to supply thereto a lubricant having an inherent pour point temperature greater than the operating temperature of the gas when expanding within the expansion chamber 110 of the expander 100, and wherein the temperature differential determined by the pour point of the lubricant and the operating temperature in the expansion chamber 110 is such that the lubricant becomes fluid under increased pressure at a point of contact of the working surfaces 124 of the expander 100, then freezes when the surfaces 124 separate. The system can include means 116 to control the temperature of the lubricant supplied to the expansion chamber 110.

Figure 2:
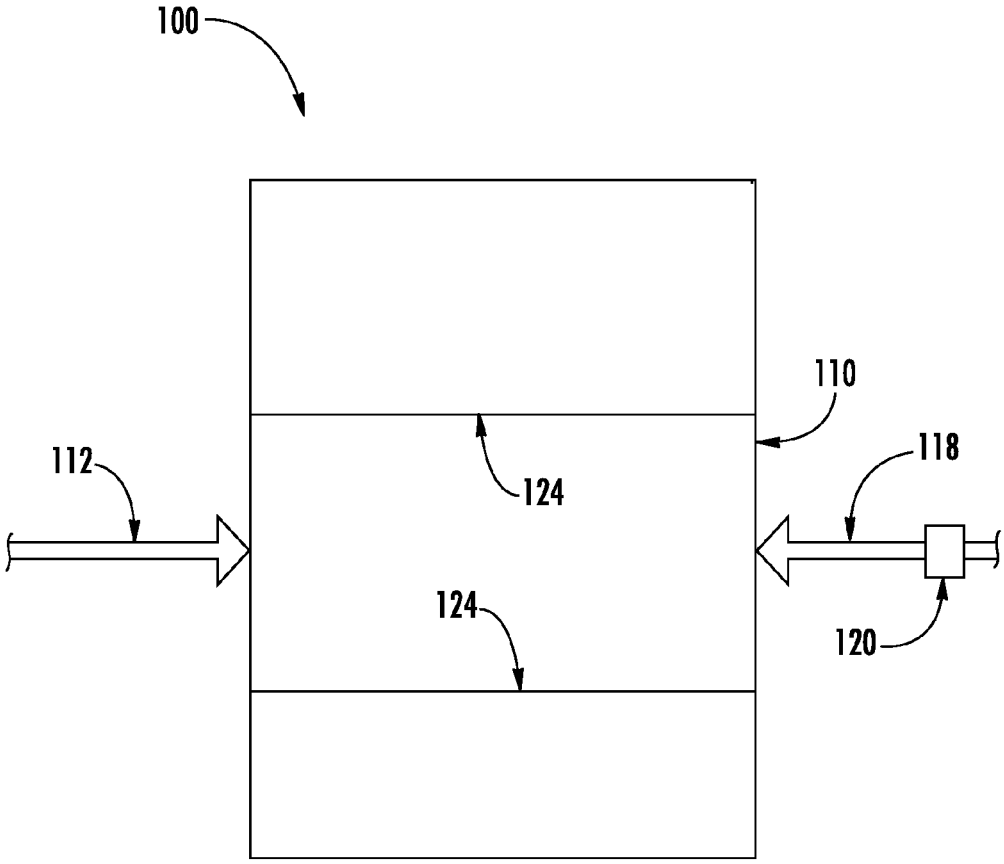
FIG. 2 depicts schematically one embodiment of a system comprising a positive displacement expander disclosed herein.

Another embodiment of a system disclosed herein is depicted schematically in FIG. 2. FIG. 2 depicts a system comprising a positive displacement expander 100 having an expansion chamber 110; a supply of compressed gas 112 connected to the expander 100; and a supply of lubricant 118 connected to the expander 100, wherein the supply of lubricant 118 provides to the expander 100 a lubricant having an inherent pour point temperature greater than the operating temperature of the gas when expanding within the expansion chamber 110 of the expander 100, and wherein the temperature differential determined by the pour point of the lubricant and the operating temperature in the expansion chamber 110 is such that the lubricant becomes fluid under increased pressure at a point of contact of the working surfaces 124 of the expander, then freezes when the surfaces 124 separate. The system can include a temperature controller 120 that controls the temperature of the lubricant supplied to the expansion chamber 110.

Figure 3:
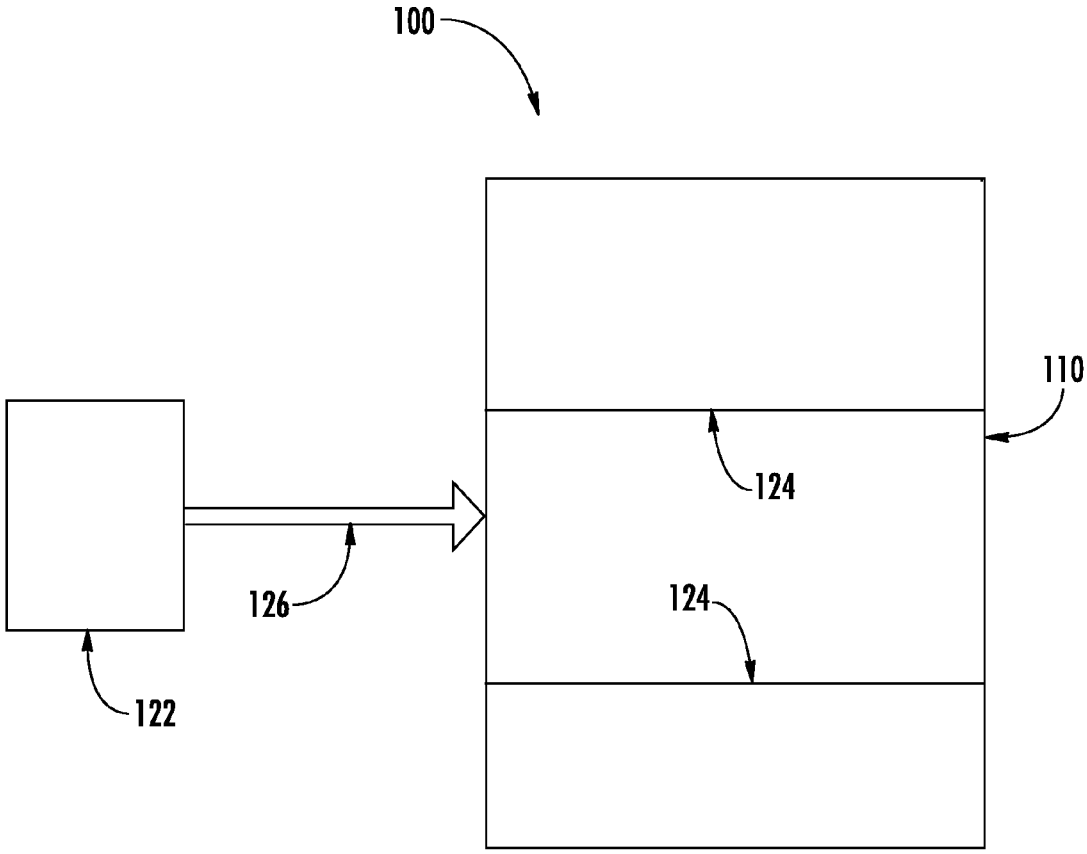
FIG. 3 depicts schematically one embodiment of a system comprising a positive displacement expander disclosed herein.

As shown schematically in FIG. 3, the system can comprise a positive displacement expander 100 having an expansion chamber 110; a supply of compressed gas 122 connected to the expander 100; wherein the lubricant is contained with the compressed gas in a storage vessel 122 prior to supply to the positive displacement expander 100. The compressed gas and lubricant can be supplied via means 126 to the expander 100, wherein the lubricant can have an inherent pour point temperature greater than the operating temperature of the gas when expanding within the expansion chamber 110 of the expander 100, and wherein the temperature differential determined by the pour point of the lubricant and the operating temperature in the expansion chamber 110 is such that the lubricant becomes fluid under increased pressure at a point of contact of the working surfaces 124 of the expander, then freezes when the surfaces 124 separate.

The invention claimed is:

1. A method of lubricating a positive displacement machine operating as an expander of a compressed gas, comprising the steps of introducing into an expansion chamber of the machine a lubricant whose pour point temperature is greater than a reduced operating temperature of the machine in said expansion chamber, wherein the reduced operating temperature of the machine in said expansion chamber is determined by expansion of the compressed gas, wherein the lubricant is caused to freeze-adhere to the internal surfaces of the expansion chamber, and wherein the temperature differential determined by the pour point of the lubricant and the operating temperature of the machine in the expansion chamber is such that the freeze-adhered lubricant becomes fluid under increased pressure at a point of contact of the working surfaces of the expander, then refreezes when the surfaces separate.

2. A method according to claim 1, wherein the lubricant is introduced into the expansion chamber simultaneously with the compressed gas to be expanded.

3. A method according to claim 1, wherein the lubricant is contained with the compressed gas in a storage vessel prior to supply to the positive displacement machine.

4. A method according to claim 1, wherein the lubricant is introduced into the expansion chamber from a reservoir separate from a storage vessel containing the compressed gas.

5. A method according to claim 1, wherein the lubricant is a mineral oil.

6. A method according to claim 1, wherein the lubricant is an aqueous liquid.

7. A method according to claim 1, wherein the pour point temperature of the lubricant exceeds the operating temperature of the machine in the expansion chamber by at least 50° C.

8. A method according to claim 1, when applied to a scroll expander.

9. A method according to claim 1, wherein the volume of lubricant introduced into the machine in a unit time is in the region of 0.0005% of the volume of compressed gas passing into the machine for the same unit time.

10. A method according to claim 1, wherein the temperature of the lubricant, prior to introduction into the expansion chamber, is controlled such that the lubricant remains fluid until frozen in the expansion chamber by the expanding gas.

11. A system comprising a positive displacement expander having an expansion chamber; a supply of compressed gas connected to the expander; and means connected to the expander to supply thereto a lubricant having an inherent pour point temperature greater than the operating temperature of the gas when expanding within the expansion chamber of the expander, and wherein the temperature differential determined by the pour point of the lubricant and the operating temperature in the expansion chamber is such that the lubricant becomes fluid under increased pressure at a point of contact of the working surfaces of the expander, then freezes when the surfaces separate.

12. A system according to claim 11, including means to control the temperature of the lubricant supplied to the expansion chamber.

13. The system according to claim 11, wherein the lubricant is contained with the compressed gas in a storage vessel prior to supply to the positive displacement expander.

14. The system according to claim 11, wherein the lubricant is a mineral oil or an aqueous liquid.

15. The system according to claim 11, wherein the pour point temperature of the lubricant exceeds the operating temperature in the expansion chamber by at least 50° C., and/or wherein the volume of lubricant introduced into the expander in a unit in time is in the region of 0.0005% of the volume of compressed gas passing into the expander for the same unit time.

16. A system comprising a positive displacement expander having an expansion chamber; a supply of compressed gas connected to the expander; and a supply of lubricant connected to the expander, wherein the supply of lubricant provides to the expander a lubricant having an inherent pour point temperature greater than the operating temperature of the gas when expanding within the expansion chamber of the expander, and wherein the temperature differential determined by the pour point of the lubricant and the operating temperature in the expansion chamber is such that the lubricant becomes fluid under increased pressure at a point of contact of the working surfaces of the expander, then freezes when the surfaces separate.

17. A system according to claim 16, including a temperature controller that controls the temperature of the lubricant supplied to the expansion chamber.

18. The system according to claim 16, wherein the lubricant is contained with the compressed gas in a storage vessel prior to supply to the positive displacement expander.

19. The system according to claim 16, wherein the lubricant is a mineral oil or an aqueous liquid.

20. The system according to claim 16, wherein the pour point temperature of the lubricant exceeds the operating temperature in the expansion chamber by at least 50° C., and/or wherein the volume of lubricant introduced into the expander in a unit in time is in the region of 0.0005% of the volume of compressed gas passing into the expander for the same unit time.

* * * * *